United States Patent [19]

Hudson

[11] 4,351,475

[45] Sep. 28, 1982

[54] ENVIRONMENTAL CONTROL ROOM DIVIDERS

[76] Inventor: James W. Hudson, P.O. Box 399, Spotsylvania, Va. 22553

[21] Appl. No.: 162,550

[22] Filed: Jun. 24, 1980

[51] Int. Cl.[3] ..... F24F 7/00

[52] U.S. Cl. ..... 237/46; 52/239; 98/40 DL

[58] Field of Search ..... 237/46; 98/334, 40 DL, 98/31; 52/239; 62/263; 126/444, 445

[56] References Cited

U.S. PATENT DOCUMENTS

| | | | |
|---|---|---|---|
| D. 232,966 | 1/1974 | Shemitz | D48/4 B |
| D. 233,468 | 10/1974 | Shemitz | D48/23 A |
| 2,201,153 | 5/1940 | Brown | 362/96 |
| 2,359,021 | 9/1944 | Campbell et al. | 250/461 B |
| 2,432,354 | 12/1947 | Temple | 98/31 |
| 3,553,916 | 1/1971 | Lickliter et al. | 52/239 |
| 3,679,893 | 7/1972 | Shemitz et al. | 240/103 R |
| 3,812,904 | 5/1974 | Westergren | 165/22 |
| 3,844,079 | 10/1974 | Karrip | 52/239 |
| 3,935,898 | 2/1976 | Westergren | 165/22 |
| 3,949,827 | 4/1976 | Witherspoon | 52/239 |
| 4,060,294 | 11/1977 | Haworth et al. | 52/239 |
| 4,258,615 | 3/1981 | Vivian | 237/46 |

*Primary Examiner*—Ronald C. Capossela
*Attorney, Agent, or Firm*—Griffin, Branigan & Butler

[57] ABSTRACT

A portable wall-like room divider rests on a floor and rises to a height of preferably at least three feet. Front and rear facings of the divider, in conjunction with edge and internal members, form a cavity in which a light source (two diverse light sources in an alternate embodiment) is positioned for producing reflected light which is transmitted through a hidden light-transmisive portion of the front facing for illuminating a designated task area of the room. An additional light filter can be added. An externally-located adjusting member is linked to the light source to allow adjustment of the position of a member of the light source so that the pattern of light passing through the light-transmissive member can be varied. The divider is brought into communication with heating (or airconditioning) ducts for dispensing heated (or cooled) air into the designated task area. The cavity communicates with an exhaust duct for exhausting heat generated by the light source, which heat is processed, preferably for reuse.

30 Claims, 8 Drawing Figures

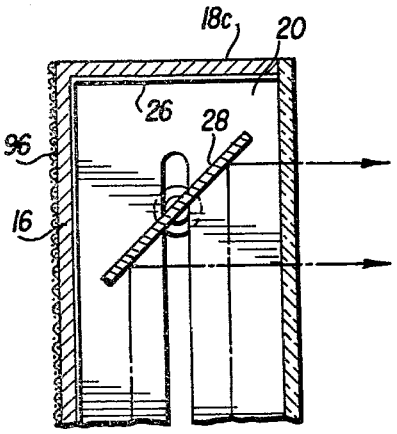
FIG. 3
FIG. 4
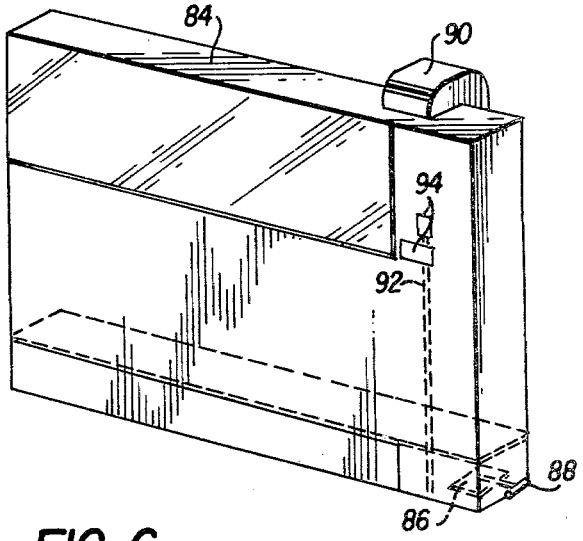
FIG. 5
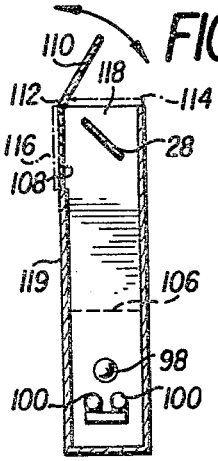
FIG. 6
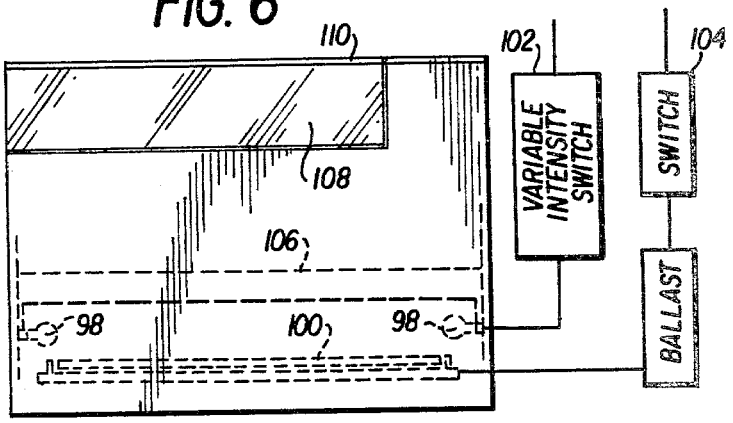
FIG. 7
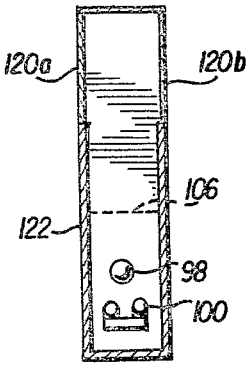
FIG. 8
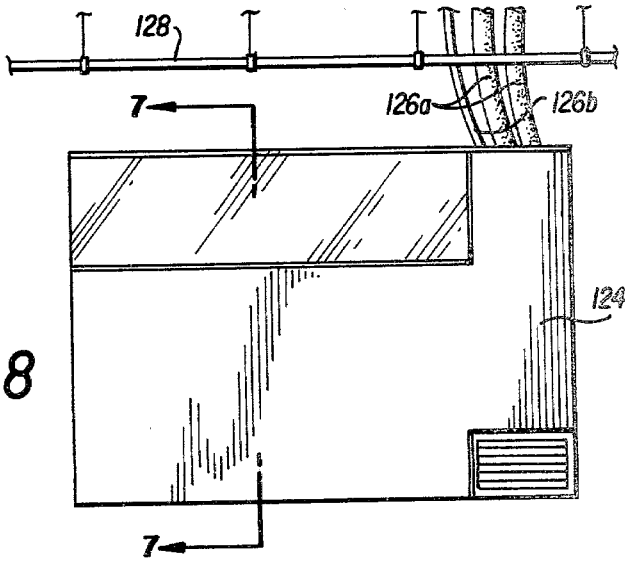

ENVIRONMENTAL CONTROL ROOM DIVIDERS

BACKGROUND OF THE INVENTION

This invention relates generally to the art of portable room dividers, and more particularly, it relates to a type of room divider which allows environmental control of particular task areas being defined by the room dividers.

Many office buildings, as well as other buildings, are constructed with large open floor space from which smaller individual work, or task, areas are carved by portable room dividers, or partitions. A difficulty encountered when employing such partitions is that, since the shapes and sizes of the task areas are not usually predictable when the building is built, they form obstacles to environmental control. That is, lighting, heating, and cooling are designed for the floor space as a whole, but the partitions often hamper the design so that one employee's task area might be too dark, another employee's task area might be too cool, etc. This problem is complicated in that environmental conditions change between winter and summer, so that the same employees who are too cool in summer might be too warm in winter, etc. Thus, it is an object of this invention to provide a room divider which can be used to define work spaces in an open room without adversely affecting environmental control of specific task areas.

In any event, managers of large buildings usually have a difficult time pleasing all occupants, in any case, with regard to the environment. What is too warm for one person is pleasing to another person; what is too cool for a third person is yet not cool enough for a fourth person, It is likewise unsatisfying for occupants to not have control of their environment and to often have to live under environmental conditions pleasing to others, but not themselves. Thus, it is another object of this invention to provide room dividers which will allow environmental control by individuals occupying specific areas. In achieving this purpose, this invention tends to promote satisfaction of employees by enabling them to control their environment.

Large buildings often have much unused space therein which nevertheless, is allowed to dissipate unnecessary environmental-control energy. For example, tall ceilings of buildings often have lights therein which are positioned quite far from the people using them. Thus, light is transmitted over whole rooms, and to many areas in which is it not needed. Similarly, some areas in which there are no people, or people only occupy in transit, are unnecessarily heated and cooled, which is wasteful. Therefore, it is an object of this invention to provide a method and system for controlling the environment of specific task areas within large rooms without the wasting of energy in adjacent areas.

In large buildings where there are numerous lights, the lights, ballasts, and other elements generate an inordinate amount of heat energy which, quite often, is thrown away as waste heat or, even worse, is allowed to detract from operation of an existing environmental control system. In the wintertime, when heat from the lights could be used for heating work areas of the building, the heat from ceiling lights is often left on the ceiling where it is too far from people to significantly aid in keeping them warm. In the summertime, when attempts are being made to aircondition buildings, heat from lights tends to cancel out a portion of the airconditioning, which is economically undesirable. Still further, when heat is left in lighting enclosures, so that it elevates the temperature of light bulbs, it reduces the life span of the light bulbs. Thus, it is yet another object of this invention to provide a method and system for recapturing heat from light bulbs and beneficially processing the heat.

It is still another object of this invention to provide a room divider, or partition, that acts as an efficient sound absorber and also produces its own locally controllable "white sound", or environmental sound, for masking sounds in a room.

It is a further object of this invention to provide a light fixture which produces exceptionally high quality, individually adjustable, and pleasing light.

SUMMARY

According to principles of this invention, a portable room divider, or partition, is shaped like a wall, normally rests on the floor, and has an efficient sound-absorbing material on at least a back face thereof. The room divider is preferably at least three feet high from the floor and a portion of the front facing thereof is constructed of a light-transmissive material, or is open. The room divider has a hidden light source in a cavity therein, offset from the light-transmissive portion of the front facing, for producing light which passes through the light-transmissive material of the front facing. An externally-located adjusting member linked to the light source allows positioning of a light-source member for controlling the illumination pattern of light passing through the light transmissive material.

In one embodiment the room dividers are coupled to heating ducts of a building to dispense heated (or cooled) air into task areas defined by the room dividers. In addition, the room-divider cavities are coupled to exhaust ducts for exhausting heated air from the light sources and transporting such heated air to processing areas for beneficially processing such heated air.

BRIEF DESCRIPTION OF THE DRAWINGS

The foregong and other objects, features and advantages of the invention will be apparent from the following more particular description of the preferred embodiment of the invention, as illustrated in the ccompanying drawings in which reference characters refer to the same parts throughout the different views. The drawings are not necessarily to scale, emphasis instead being placed upon illustrating principles of the invention in a clear manner.

FIG. 3 is a sectional view taken on lines 3—3 of FIG. 2;

FIG. 4 is an isometric view of a room partition similar to those of FIG. 1, but with an external floor-type utility hookup being shown for illustrative purposes;

FIG. 5 is a side sectional view of another embodiment of this invention;

FIG. 6 is a front view of the FIG. 5 embodiment, with a block diagram depicting electrical controls for light sources thereof;

FIG. 7 is a side sectional view of another embodiment of this invention; and

FIG. 8 is a front view of the FIG. 7 embodiment with additional conduit elements being shown.

DESCRIPTION OF THE PREFERRED EMBODIMENT

Figure 1:
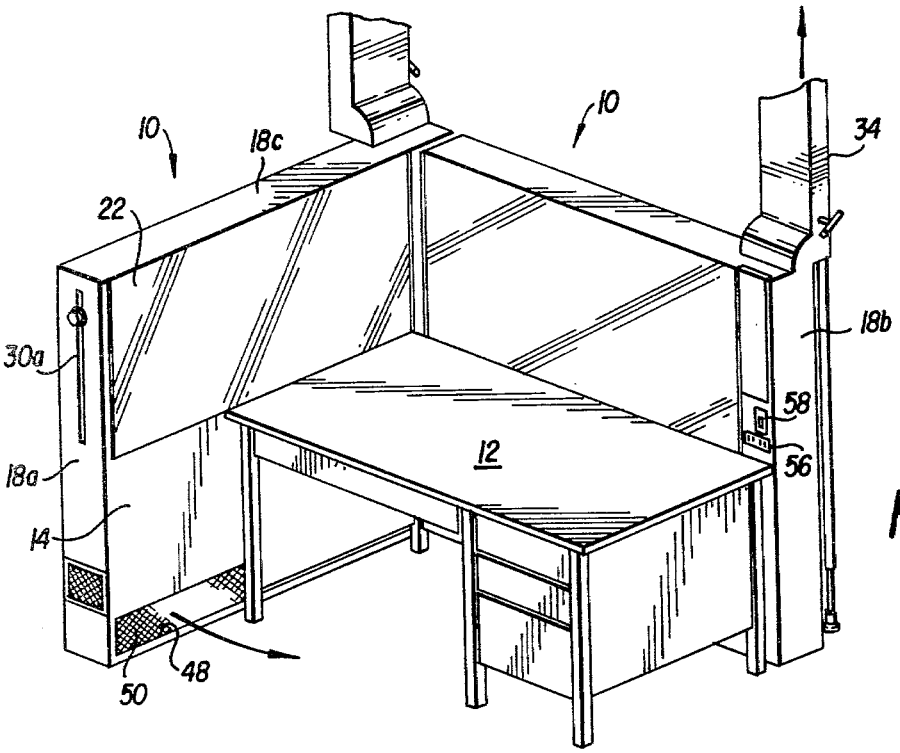
FIG. 1 is an isometric view of two room dividers, or partitions, according to principles of this invention, defining a desk task space and coupled to utility conduits.

Referring to FIG. 1, room dividers, or partitions, 10 according to this invention, are arranged to define a work space, or task area, for a desk 12. Each of the room dividers 10 is preferably at least three feet tall so as to be higher than work surfaces of desks, and other tables, and is wall-shaped. However, where work spaces are closer to the floor they can be as low as two feet high. Each room divider 10 has a front facing 14, a rear facing 16 (FIG. 3) side, top and bottom edge members 18*a*, *b*, *c*, and *d*, and internal partitions 19*a* and *b*. The front facing 40, rear facing 16, side and top edge members 18*a* and 18*c*, and internal partitions 19*a* and *b* define a light-source cavity 20 therein.

An upper portion of the front facing 14 is open or is formed of a translucent, or otherwise light-transmissive material, 22 which is positioned, at least in part, above the work surface of the desk 12. The translucent material 22 allows passage of light from the cavity 20 that is produced by a light source 24, such as a fluorescent light bulb or tube. It will be noted in FIG. 2 that the fluorescent light bulb 24 is offset in the light-source cavity 20 far below the translucent material 22. Thus, the light-transmissive material 22 and the light source 24 are "hidden" from one another such that very little, less than 10% if any, light passes directly from the light source 24 through the light-transmissive material 22. In this respect, the interior of the light-source cavity 20 is covered with a totally, insofar as possible, reflective material 26 and positioned close to the top of the light-source cavity 20 is an adjustable mirror 28. The mirror's position can be changed in two ways: it can be vertically slid in slots 30*a* and 30*b* (in the side edge member 18*a* and in the internal partition 19*a* respectively); and it can be rotated about an axis 32. By properly adjusting the position of the mirror 28, one can control the pattern of light passing through the translucent material 22 toward the work surface of desk 12. In an undepicted embodiment, the mirror 28 is preadjusted to a fixed position, and cannot be further adjusted. The reflective material 26 can be a highly reflective paint, for example, or can also be mirrors.

Figure 2:
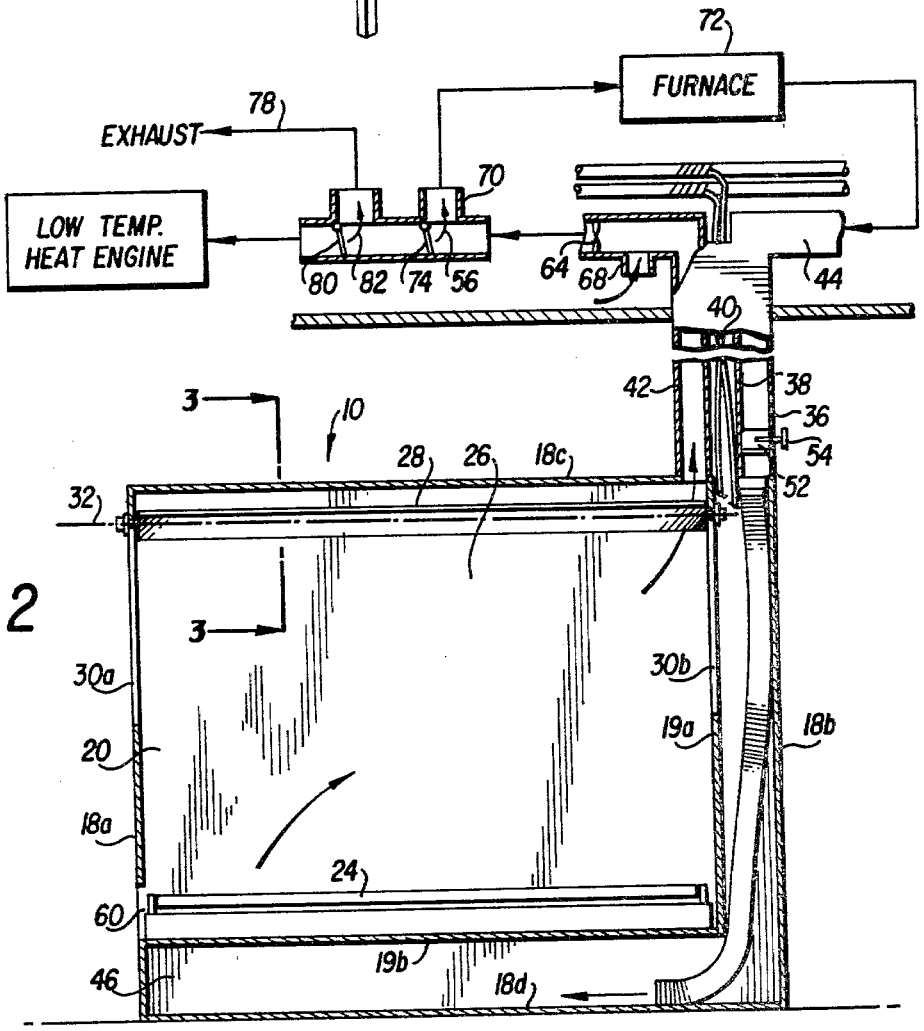
FIG. 2 is a sectional view of a single room divider of FIG. 1 showing the manner in which the utility conduits are integrated into a building system of this invention, a portion of the system being illustrated schematically.

The room dividers, or partitions, 10 further enable an individual to control his task, or work, area environment by controlling the amount of heated air in winter, and cool air in summer, that is dispensed into the task area. In this respect, in the FIG. 1 embodiment each of the room dividers 10 is attached to utility conduits 34, which are shown as packaged units in FIG. 1. In FIG. 2 it can be seen that each of the packaged units actually comprises three conduits, the first conduit 36 being a temperature-control conduit, the second conduit 38 being an electrical conduit for housing power lines (including low voltage power for intercoms, 110 v, and higher voltages for electrical machines, for example) and telephone lines 40, and the third conduit 42 being a heat-exhaust conduit for capturing heat created by the light source 24.

With regard to the first conduit, or temperature-control conduit 36, this conduit is attached to a building heat duct 44 for channeling heated air in winter, and cool air in summer, from the main heat duct 44 to a temperature control cavity 46 in the room divider 10 defined by the front and rear facings 14 and 16, the side and bottom edge members 18*b* and 18*d*, and by the internal partitions 18*a* and 18*b*. The temperature-control cavity 46 does not substantially communicate with the light-source cavity 20, but rather has an outlet 48 (shown with a grill 50 thereon in FIG. 1) for allowing this heated, or cooled air to exit from the room divider 10 into the partitioned task area. An adjustable flutter baffle 52, or similar control, having an outside handle 54 coupled thereto, is mounted in the temperature control conduit 36 so that an individual can control the amount of heated, or cooled, air exiting from the outlet 48 into his task area.

With regard to the second conduit, or electrical conduit 38, this conduit merely allows the passage of electrical wires to electrical outlets 56, and electrical wires for supplying low potential for telephones, video cable, control circuits, alarms, etc. In an unillustrated embodiment, this conduit is actually divided into two subconduits, one for high voltages, and one for low voltages.

Turning next to the third conduit, or heat exhaust conduit 42, this conduit communicates with the light-source cavity 20. In addition, the light-source cavity 20 has an opening 60 therein for communicating the light-source cavity 20 with outside atmosphere adjacent to the light source 24, and on the opposite side thereof from the heat exhaust conduit 42.

An air impeller 64 is positioned in a heat collection conduit 66 which collects heat from light-source cavities of several room dividers 10 (a second tributary line 68 from another room divider which is not shown is depicted in FIG. 2). This heated air is then beneficially processed in an appropriate manner. There are numerous beneficial ways to process this heated air and, for the sake of economy, many of these ways are shown in a single system in the embodiment of FIG. 2. In one mode of operation of this system, the heated air is channeled to a return cool air duct 70 which transports the air back to a furnace 72 where it is reheated and fed to the building heat duct 44 which, in turn, feeds the heated air to heat registers such as the outlet 48 in the room dividers 10. In this manner, heat from the various light sources 24 are collected and added to the heated air of the overall heating system for redistribution so as to lighten the load of the heating system. Of course this mode of operation of the invention will be employed mainly in the wintertime when the furnace 72 is running.

However, in the summertime, when an airconditioner is used rather than a furnace 72, a valve 74 can be moved as is indicated by an arrow 76 to thereby channel heated air coming from the light source 24 to an exhaust 78 which exhausts the heated air to outside atmosphere. Thus, in this mode of operation, which is usually used in the summertime, air which is heated by the light source 24 does not counteract the operation of an airconditioner. In yet another mode of operation, a valve 80 can be moved as is indicated by arrow 82 to channel the heated air to a low-temperature heat engine to aid in driving an airconditioner, or some other machinery or heater.

FIG. 4 depicts an embodiment of this invention which is quite similar to the embodiment of FIGS. 1–3 with the exception that the utility hookups to the room divider 84 are from the floor rather than from the ceiling. Thus, it can be seen that a manual flutter valve 86 having an external control handle 88, is mounted near the floor to prevent heated or cooled air from reaching the outlet 48 and a separate conduit 90 extends along the back, to the top of the room divider 84 to capture light-source heat. The light-source heat is otherwise channeled in the same manner as is depicted in FIG. 2. Electrical and telephone lines 92 extend upwardly from the floor to outlets 94.

The outside of the room dividers 10 and 84, especially the back facing 16 thereof, is covered with a barrier of acoustical material 96, and in addition, the reflective material 26 aids in preventing the passage of sound through the room dividers 10. In one embodiment the acoustical material 96 is burlap and the reflective material 26 is a rather thick tin or aluminum foil.

In a preferred embodiment, the room dividers 10 and 84 are about five feet high, four and one-half feet wide and five and one-half inches thick. Other than the translucent material 22, the various baffles and walls of the room divider 10 and 84 are constructed of wood, or wood substitutes such as pressed board, however, they can also be constructed of metal or plastic. In this respect, however, if they are constructed of metal or plastic they may not absorb sound as efficiently as if they were made of wood.

In most cases, it is important that the room dividers are at least three feet high so that a portion thereof extends over a normal working surface of a table to provide light through a translucent material facing to the working surface. However, where they are to be used to light floor areas, they can be as low as two feet.

In operation, a building is built without a substantial number of area heat registers for dispensing heat, however, sufficient heat ducts are in place for heating the entire building. Once the building is ready for occupancy, the occupying parties arrange room dividers 10 or 84 (depending on whether the utilities are in the ceiling or floor) therein as they desire them. Mechanical contractors and electricians then make the necessary utility hookups, as described above, to the dividers. Thereafter, workers in the task areas defined by the room dividers can control their own work environments as they desire. A similar procedure is followed for modifying the room divider arrangement.

FIG. 5 depicts yet another embodiment of this invention. In the FIG. 5 embodiment, there are at least two diverse light sources 98 and 100. The first light source 98 is, for example, incandescent light bulbs, while the second light source is fluorescent light bulbs. These light sources 98, 100 are separately controlled by respective switches 102 and 104. The switch 102 for controlling the incandescent light bulbs 98 is not only an off/on switch but also variably controls the intensity of the incandescent light bulbs. By using this system, light can be individually controlled to combine the virtues of diverse type light systems. In the illustrated embodiment, light from the two different systems can be, to some extent, blended as is desired by the user for beneficial results. It will be understood by those skilled in the art that various other types of different types of light sources can be used together. For example, yellowish colored light from sodium vapor light sources can be combined with relatively blue fluorescent light to yield interesting hues. Also, one can obtain the substantially instant start of an incandescent light source while still having the increased intensity, and more efficient, sodium vapor light source utilized in conjunction therewith. It is, as will be readily appreciated, possible to combine three, and more different types of light sources as is desired for individual control of uses. The light fixture of this invention is particularly suited for combining various types of light sources since its hidden-light concept with numerous reflections prior to light escapement, mix and blend light from the various sources.

Another feature of the FIGS. 5 and 6 embodiment, is a light filter 106 which is inserted above light sources 98 and 100 but below a fixture opening 108. The filter 106, in one embodiment, only allows passage of polarized light. In this case, the filter can be made of polarizing material such as NICOL or POLAROID. In another embodiment, this filter allows passage of only certain colors of light. In yet another embodiment, the filter 106 is merely a diffuser. In all of these cases, the filter 106 enhances the blending and mixing of light broadcast by the light sources 98 and 100. prior to its escapement from the opening 108.

Yet another feature of the FIG. 5 and FIG. 6 embodiment is that it includes a cover 110. The cover 110 is rotatable about a hinge 112 between two positions 114 and 116. In the first position 114 the cover 110 covers an opening 118 at the top of a housing 119. In this position, substantially all of the light produced by the light sources 98 and 100 passes through the opening 108 as in the embodiments of FIGS. 1–4. However, in the second position 116, the cover 110 covers the opening 108 and uncovers the top opening 118 to allow light produced by the light sources 98 and 100 to exit from the top of the housing 119 and thereby strike a room ceiling and provide indirect lighting for a room. The intensity of this light can be controlled by controlling the angle of the mirror 28. Thus, with the FIG. 5 embodiment, one can provide either of two types of light, task lighting, or indirect room lighting. In an unillustrated embodiment, the housing 119 does not have the cover 110 and light is always allowed to pass through both the front opening 108 and the top opening 118 to both provide task lighting and indirect room lighting. In this embodiment the amounts of light passing through the respective openings is determined, to a large extent, by the angle of the mirror 28.

Looking at the FIG. 7 embodiment, this embodiment is similar to the other embodiments already described, with the exception that there are two task-light openings 120*a* and *b* on opposite sides of a housing 122.

FIG. 8 depicts an embodiment of this invention in which a housing 124 is connected with hot and cold air heating ducts and electrical utilities by means of flexible hoses 126*a* and 126*b*. Numeral 128 identifies a suspended ceiling in FIG. 8.

It will be appreciated by those skilled in the art that the room dividers of this invention provide highly beneficial individual environmental control for specific task areas by allowing individuals to control light illumination patterns, light quality and temperature. In addition, these room dividers are highly effective in absorbing sounds, to thereby control the noise level of the task area. By masking surrounding sounds, the room dividers of this invention allow an easy understanding of conversations within the task areas and virtually eliminate the requirement for "white sound" within a room. In any case, if "white sound" is required, individuals can control their own.

Finally, the environmental room dividers of this invention provide for the efficient use of energy by allowing the evacuation, and beneficially processing of light-source heat energy.

While the invention has been particularly shown and described with reference to a preferred embodiment, it will be understood by those skilled in the art that various changes in form and detail may be made therein without departing from the spirit and scope of the invention.

For example, although a height of five feet is normally adequate for most environmental control room dividers, if a desk or work surface is unusually large or high, a larger room-divider height may be desirable in order to properly disseminate the light.

In addition, although in the depicted embodiment the light source 24 is shown located close to the bottom of the room divider it could be located almost anywhere inside the room divider, and could also be located at the top of the room divider. In this regard, the light source 24 itself could be adjustable for controlling the pattern of light passing through the diffuser 22. Also, the diffuser 22 could polarize light passing therethrough or could filter various colors.

It should be appreciated that the manner of positioning the light source 24 depicted in FIG. 2, and in other figures, provides an indirect lighting wherein light from the light bulb (such as a fluorescent light and other sources) is the result of many reflections. This is especially desirable for fluorescent tubes which have a natural flicker, this flicker being smoothed somewhat by the indirect lighting.

Although the duct 90 is shown external of the room divider 84, this is for illustrative purposes only, and it would most likely be internal thereof.

The embodiments of the invention in which an exclusive property or privilege is claimed are defined as follows:

1. A portable wall-like room divider for resting on the floor and rising to a height of at least three feet, said wall-like room divider having a front facing, a rear facing, and edge members forming a light-source cavity therein wherein an upper portion of said front facing is formed of a light transmissive material, and wherein a light source is positioned inside said light-source cavity for producing light to be transmitted through said light-transmissive material, an adjusting means linked with said light source, but being external of said light-source cavity for adjusting, from outside said light-source cavity, the position of a member of said light source, and thereby adjusting the pattern of said light passing through said light-transmissive member.

2. A portable wall-like room divider as in claim 1 wherein the walls of said cavity have a substantially reflective surface.

3. A portable wall-like room divider as in claim 2 wherein said light source comprises a light bulb and a reflector positioned in said cavity, said reflector being spaced from said light bulb, said reflector being adjacent to said light-transmissive material and said adjusting means being linked to said reflector for adjustment thereof, the position of said reflector being adjustable.

4. A portable wall-like room divider as in claim 3 wherein said reflector can be both rotated and moved longitudinally toward and away from said light bulb.

5. A portable wall-like room divider as in claim 1 and further including a means for attaching said room divider to a heating and cooling duct for receiving heated and cooled air from said duct and dispensing said heated and cooled air into a task area defined by said room divider.

6. A portable wall-like room divider as in claim 5 wherein is further included a means for attaching said room divider to an exhaust duct, said exhaust duct communicating with said light-source cavity for exhausting heated air from said light-source cavity.

7. A portable wall-like room divider as in claim 1 wherein is further included a means for attaching said room divider to an exhaust duct, said exhaust duct communicating with said light-source cavity for exhausting heated air from said light-source cavity.

8. A light source system comprising:

an enclosure having at least one light transmissive wall, said enclosure defining a cavity therein and further defining inlet and outlet openings into said cavity;

a light source positioned inside said cavity for generating light to pass through said light transmissive wall; and an outlet pipe attached to said enclosure at said outlet opening for guiding warm air exiting from said enclosure cavity away from said enclosure into a heat processing area where said heat is appropriately processed;

said inlet opening communicating said cavity with outside atmosphere;

wherein said enclosure is a portable wall-like work space divider that rests on the floor and extends at least three feet high.

9. A light source system as in claim 8 wherein a furnace is located at said heat processing area for receiving said warm air exiting from said enclosure and for reheating said warm air, and wherein said furnace is further coupled to heating ducts which lead said further heated air to heat registers.

10. A light source system as in claim 8 wherein said heat processing area comprises a vent to outside atmosphere and wherein said warm air is vented to outside atmosphere.

11. A light source system as in claim 8 wherein said portable wall-like space divider is at least four feet high.

12. A light source system comprising:

an enclosure having at least one light transmissive wall, said enclosure defining a cavity therein and further defining inlet and outlet openings into said cavity;

a light source positioned inside said cavity for generating light to pass through said light transmissive wall; and an outlet pipe attached to said enclosure at said outlet opening for guiding warm air exiting from said enclosure cavity away from said enclosure into a heat processing area where said heat is appropriately processed;

said inlet opening communicating said cavity with outside atmosphere;

wherein said enclosure is a portable wall-like work space divider that rests on the floor and extends at least three feet high and wherein a heating duct is attached to said enclosure and said enclosure receives heated and cooled air from said heating duct and further dispenses said heated and cooled air into a task area defined by said room divider.

13. A portable wall-like, room divider for resting on a floor and rising to a height of at least three feet, said wall-like room divider having a front facing, a rear facing, and edge members forming a cavity therein, said room divider further including a wall positioned in said cavity for separating said cavity into at least two subcavities, walls of said room divider defining openings into said first and second subcavities for communicating said first and second cavities with the surrounding atmosphere, means for attaching a heat duct to said room divider so that said heat duct is in communication with a first one of said subcavities, means for attaching a cold air return of a building heating system to said room divider for bringing said cold air return duct into communication with the second of said subcavities, whereby temperature-controlled air delivered to said room divider via said heat duct is dispensed in a work area defined by said room divider through said first subcavity and wherein surrounding atmosphere air is sucked into said room divider through said second subcavity for returning to said furnace.

14. A portable wall-like room divider as in claim 13 wherein is further included a control means for controlling the amount of temperature-controlled air dispersed by said room divider.

15. A portable wall-like room divider as in claim 14 wherein said room divider further includes a light source in said second cavity and a wall of said second cavity is constructed of a translucent material for transmitting light from said light source to the surrounding atmosphere.

16. A room lighting fixture comprising:

a housing having a front wall, a rear wall, and edge walls forming a light-source cavity therein, said light source cavity having a light transmissive hidden opening in a wall thereof, inner surfaces of said walls being highly reflective;

a light source positioned inside said cavity at a location substantially removed from said hidden opening so that only a minor portion of light from said light source passes directly from said light source through said opening, the major portion of said light reflecting from said reflective inner surfaces before passing through said opening.

17. A room lighting fixture as claimed in claim 16 wherein at least 90% of light from said light source is reflected prior to passing through said hidden opening.

18. A room lighting fixture as in claim 17 wherein there are at least two hidden offset openings in said housing, each of which is removed from said light source such that 90% of light passing from said light source through said two openings is reflected inside said housing first.

19. A room lighting fixture as in claim 17 wherein said room lighting fixture is vertically oriented, with said light source being positioned below said hidden opening, and said hidden opening being in a side wall of said light fixture, there being an additional opening positioned above said light source for allowing passage of direct light from said light source toward a ceiling of a room in which said room lighting fixture is located.

20. A room lighting fixture as in claim 19 wherein is further included a cover for selectively and alternately covering either said hidden opening or said top opening.

21. A room lighting fixture as in claim 19 wherein is further included a mirror in said housing whose angular position determines the amount of light thereby reflected through said hidden opening and said direct light through said top opening.

22. A room lighting fixture as in claim 21 wherein the angular position of said mirror is selectively adjustable.

23. A room lighting fixture as in claim 16 wherein said lighting source includes at least two disparate light producing elements.

24. A room lighting fixture as in claim 23 wherein each of said disparate light producing elements has individual control switches therefor.

25. A room lighting fixture as in claim 24 wherein at least one of said control switches includes an intensity control.

26. A room lighting fixture as in claim 23 wherein is further included a light filter positioned in said housing above said light source but below said opening for filtering all light passing from said light source to said opening.

27. A room lighting fixture as in claim 26 wherein said light filter allows the passage of substantially only polarized light.

28. A room lighting fixture as in claim 16 wherein is further included a light diffuser covering said opening.

29. A room lighting fixture as in claim 28 wherein said light diffuser allows passage of substantially only polarized light.

30. A portable wall-like, room divider for resting on a floor and rising to a height of at least three feet, said wall-like room divider having a front facing, a rear facing, and edge members forming a cavity therein, means for attaching a heat duct to said room divider so that said heat duct is in communication with said cavity, walls of said room divider defining openings into said cavity for communicating said cavity with surrounding atmosphere, whereby temperature-controlled air delivered to said room divider via said heat duct is dispensed in a work area defined by said room divider through said cavity to thereby affect temperature of an air mass adjacent to said room divider in said atmosphere.

* * * * *